US009650232B2

(12) United States Patent
Sugano et al.

(10) Patent No.: US 9,650,232 B2
(45) Date of Patent: May 16, 2017

(54) HYDRAULIC DRIVE APPARATUS FOR WORK MACHINE

(71) Applicants: Kobe Steel, Ltd., Kobe-shi (JP); KOBELCO CRANES CO., LTD., Shinagawa-ku (JP)

(72) Inventors: Naoki Sugano, Kobe (JP); Naoto Hori, Akashi (JP); Takaharu Michida, Akashi (JP)

(73) Assignees: Kobe Steel, Ltd., Kobe-shi (JP); KOBELCO CRANES CO., LTD., Shinagawa-ku (JP)

( * ) Notice: Subject to any disclaimer, the term of this patent is extended or adjusted under 35 U.S.C. 154(b) by 326 days.

(21) Appl. No.: 14/077,508

(22) Filed: Nov. 12, 2013

(65) Prior Publication Data

US 2014/0130488 A1 May 15, 2014

(30) Foreign Application Priority Data

Nov. 13, 2012 (JP) ..... 2012-249062

(51) Int. Cl.
*F15B 15/02* (2006.01)
*B66D 1/44* (2006.01)
*F15B 11/024* (2006.01)

(52) U.S. Cl.
CPC ..... *B66D 1/44* (2013.01); *F15B 11/024* (2013.01); *F15B 2011/0243* (2013.01);
(Continued)

(58) Field of Classification Search
CPC ..... F15B 11/044; F15B 11/042; F15B 21/14; F15B 2211/6346; F15B 2211/88;
(Continued)

(56) References Cited

U.S. PATENT DOCUMENTS 3,895,564 A * 7/1975 Pinson ..... B66D 1/44 60/905
5,460,001 A * 10/1995 Kato ..... E02F 9/2232 60/426

(Continued)

FOREIGN PATENT DOCUMENTS

CA 2 698 049 C 10/2014
CN 102656372 A 9/2012

(Continued)

OTHER PUBLICATIONS

Office Action mailed Nov. 9, 2015 in co-pending U.S. Appl. No. 14/077,532.

*Primary Examiner* — F. Daniel Lopez
*Assistant Examiner* — Richard Drake
(74) *Attorney, Agent, or Firm* — Oblon, McClelland, Maier & Neustadt, L.L.P.

(57) ABSTRACT

Provided is a hydraulic drive apparatus for working machine capable of preventing an excessive pressure reduction on a meter-in side and moving a load in a lowering direction at a stable speed requiring no counter balance valve. The apparatus includes a hydraulic pump, a hydraulic actuator for lowering the load, an operating device, a hydraulic circuit including a meter-in flow passage, a meter-out flow passage and a regeneration flow passage, a control valve, a meter-in-flow-rate controller for controlling a meter-in flow rate, a meter-out-flow-rate controller for controlling a meter-out flow rate to one not lower than the meter-in flow rate, a back pressure generator located downstream of the regeneration flow passage in the meter-out flow passage, and a meter-out-flow-rate limiter. The meter-out-flow-rate limiter minimizes a flow passage area of the meter-out orifice when a pressure in the meter-in flow passage falls to or below a permissible pressure.

4 Claims, 10 Drawing Sheets

(52) U.S. Cl.
CPC ..... *F15B 2211/3053* (2013.01); *F15B 2211/3058* (2013.01); *F15B 2211/329* (2013.01); *F15B 2211/351* (2013.01); *F15B 2211/40569* (2013.01); *F15B 2211/415* (2013.01); *F15B 2211/428* (2013.01); *F15B 2211/46* (2013.01); *F15B 2211/7058* (2013.01); *F15B 2211/761* (2013.01)

(58) Field of Classification Search
CPC ..... F15B 11/02; B66D 1/44; E02F 9/2282; E02F 9/2217; E02F 9/2228; E02F 9/2285
USPC ..... 60/460, 464, 484
See application file for complete search history.

(56) References Cited

U.S. PATENT DOCUMENTS 6,050,090 A * 4/2000 Tohji ..... E02F 9/2203 60/421
6,389,953 B1 * 5/2002 Altman ..... B66F 9/22 414/708
6,467,264 B1 * 10/2002 Stephenson ..... F15B 11/006 60/368
6,837,140 B2 * 1/2005 Oka ..... E02F 9/2207 91/33
7,392,653 B2 * 7/2008 Sugano ..... F15B 11/0423 60/452
7,444,809 B2 11/2008 Smith et al.
7,451,685 B2 * 11/2008 Tabor ..... F15B 11/006 91/361
7,905,088 B2 3/2011 Stephenson et al.
9,181,070 B2 * 11/2015 Sugano ..... B66D 1/44
9,187,297 B2 * 11/2015 Sugano ..... B66D 1/44
9,316,236 B2 * 4/2016 Kondo ..... F15B 9/08
2005/0011190 A1 * 1/2005 Bitter ..... B66F 9/065 60/468
2009/0288408 A1 11/2009 Tozawa et al.
2009/0308068 A1 * 12/2009 Yoshino ..... E02F 9/2203 60/468
2012/0233997 A1 9/2012 Andruch, III et al.
2012/0240566 A1 9/2012 Ohtsuka et al.
2013/0199170 A1 8/2013 Neumann et al.

FOREIGN PATENT DOCUMENTS

JP 2000-310201 11/2000
JP 2004-44667 A 2/2004
JP 3968911 B2 8/2007

* cited by examiner

HYDRAULIC DRIVE APPARATUS FOR WORK MACHINE

BACKGROUND OF THE INVENTION

Technical Field

The present invention relates to a hydraulic drive apparatus for moving a load such as a suspended load in the same direction as a self-weight falling direction, in which the load falls by its own weight, in a working machine such as a crane.

Description of the Background Art

As an apparatus for moving a load in the same direction as its self-weight falling direction, there is known a lowering drive apparatus for driving, for example, a winch for hanging a suspended load by a wire in a lowering direction. In this apparatus, it is important to prevent the suspended load from falling down due to stall resulting from a drop in meter-in side pressure which causes cavitation during lowering drive.

As a means for preventing such a drop in the meter-in side pressure, it is disclosed in Japanese Unexamined Patent Publication No. 2000-310201 to provide so-called an external-pilot-controlled counter balance valve in a meter-out side flow passage. This external-pilot-controlled counter balance valve operates to choke the meter-out side flow passage when the meter-in side pressure falls to or below a set pressure, thereby preventing the meter-in side pressure from excessive drop.

The control by the external-pilot-controlled counter balance valve, however, has a problem of being inherently unstable and prone to hunting, because respective positions of the measurement point and the control point are different from each other, specifically, having its pressure measurement point on the meter-in side while having its pressure control point on the meter-out side; thus, so-called co-location is not present in control theory.

To prevent the hunting, there can be provided such an orifice as to apply considerable damping to a valve opening operation of the counter balance valve in a pilot fluid passage; however, this orifice extends a valve opening time of the counter balance valve to thereby degrade the response of the counter balance valve. Furthermore, the orifice generates large orifice resistance in the counter balance valve until the full open of the valve, thus generating an unnecessary boost pressure.

To prevent the hunting, the above Japanese Unexamined Patent Publication No. 2000-310201 also discloses a communicating valve for allowing communication between the meter-in side flow passage and the meter-out side flow passage and a flow rate regulating valve for controlling a meter-in flow rate so as to decrease a differential pressure between the both flow passages; however, this technique involves a difficulty of obtaining a stable lowering speed. Specifically, in a general lowering control circuit, there occurs a holding pressure corresponding to the weight of a suspended load at the meter-out side, which increases a differential pressure between the meter-in side and the meter-out side with an increase in the load of the suspended load. This increases opening degree of the flow rate regulating valve on the meter-in side, thereby increasing the meter-in flow rate. Thus, in this apparatus, the lowering speed is largely varied depending on the weight of the load.

SUMMARY OF THE INVENTION

An object of the present invention is to provide a hydraulic drive apparatus for working machine capable of preventing pressure on a meter-in side from excessive drop while not involving hunting or generation of a large boost pressure, which are drawbacks of a conventional counter balance valve, and capable of moving a load in a lowering direction, which is the same direction as a self-weight falling direction in which the load falls by its own weight, at a stable speed.

A hydraulic drive apparatus for working machine provided by the present invention includes: a hydraulic pump; a drive source for driving the hydraulic pump and making the hydraulic pump discharge hydraulic fluid; a hydraulic actuator which includes a first port and a second port and is operated to move the load in the lowering direction by receiving supply of the hydraulic fluid discharged from the hydraulic pump through the first port and discharges the hydraulic fluid through the second port; a hydraulic circuit which includes a meter-in flow passage for leading the hydraulic fluid from the hydraulic pump to the first port of the hydraulic actuator in moving the load in the lowering direction, a meter-out flow passage for leading the hydraulic fluid discharged from the second port of the hydraulic actuator to a tank in moving the load in the lowering direction and a regeneration flow passage for bringing the meter-out flow passage into communication with the meter-in flow passage; a control valve which is operated to change a state of the supply of the hydraulic fluid from the hydraulic pump to the hydraulic actuator; an operating device for operating the control valve; a meter-in-flow-rate controller for controlling a meter-in flow rate, which is a flow rate of the hydraulic fluid in the meter-in flow passage; a meter-out-flow-rate controller for controlling a meter-out flow rate, which is a flow rate of the hydraulic fluid in the meter-out flow passage upstream of a position where the regeneration flow passage is connected to the meter-out flow passage, so as to make the meter-out flow rate be not lower than the meter-in flow rate controlled by the meter-in-flow-rate controller; a back pressure generator provided at a position downstream of the position where the regeneration flow passage is connected to the meter-out flow passage in the meter-out flow passage to generate a set back pressure; a check valve provided in the regeneration flow passage to limit a direction of the flow of the hydraulic fluid in the regeneration flow passage to a direction from the meter-out flow passage to the meter-in flow passage; and a meter-out-flow-rate limiter for forcibly limiting the meter-out flow rate when a pressure of the hydraulic fluid in the meter-in flow passage falls to or below a preset permissible pressure. The meter-out-flow-rate controller includes a meter-out orifice provided in the meter-out flow passage and having a variable flow passage area and a meter-out-flow-rate regulating valve for varying the meter-out flow rate so as to make a differential pressure across the meter-out orifice be a set pressure. The meter-out-flow-rate limiter minimizes the flow passage area of the meter-out orifice, preferably, makes the meter-out orifice be fully closed, when the pressure of the hydraulic fluid in the meter-in flow passage falls to or below the permissible pressure. The back pressure generator may be a back pressure valve for generating a set back pressure or may be another device (valve or the like) or a pipe, other than the back pressure valve, provided at a downstream side of the meter-out flow passage, which device or pipe has a large pressure loss enough to ensure a required back pressure, that is, the back pressure generator may be configured based on utilization of the pressure loss.

EMBODIMENTS OF THE INVENTION

A first embodiment of the present invention is described with reference to FIGS. 1 to 4.

Figure 1:
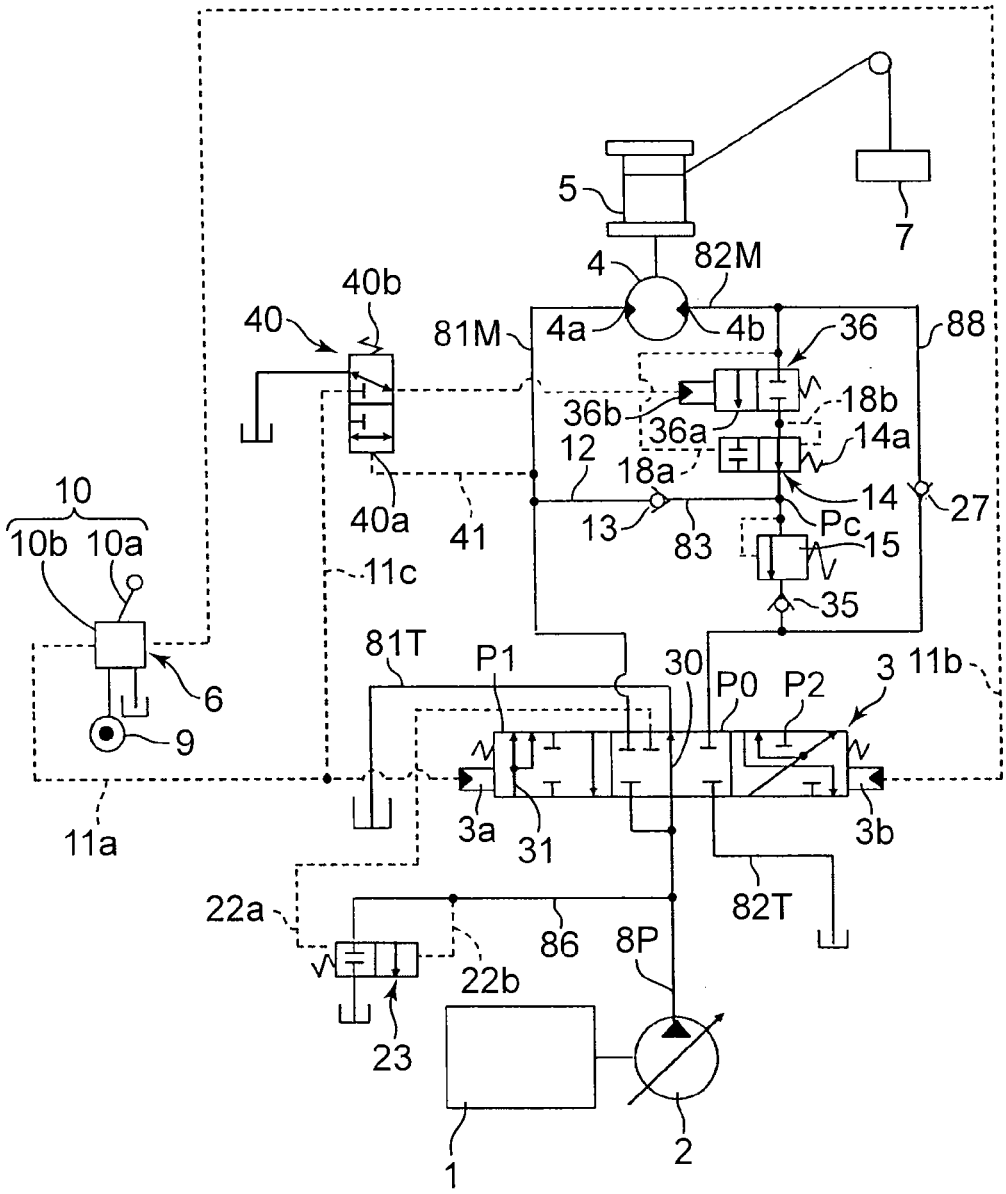
FIG. 1 is a circuit diagram showing a hydraulic drive apparatus for working machine according to a first embodiment of the present invention.

FIG. 1 is a circuit diagram showing the overall configuration of a hydraulic drive apparatus according to the first embodiment. This apparatus includes an engine 1, a hydraulic pump 2, a hydraulic motor 4 as a hydraulic actuator, a hydraulic circuit, an operating device 6 for operation of the rotation speed of the hydraulic motor 4, a control valve 3, a meter-out-flow-rate controller, a meter-in-flow-rate controller, a back pressure valve 15 and a check valve 13.

The engine 1 is a power source of the hydraulic pump 2. The hydraulic pump 2 is driven by the engine 1, thereby discharging hydraulic fluid in a tank. In this embodiment, a variable displacement type hydraulic pump is used as the hydraulic pump 2.

The hydraulic motor 4, which is an example of a hydraulic actuator according to the present invention, is incorporated into a winch device including a winch drum to hoist and lower a suspended load 7 as a load by rotating the winch drum 5 in either of forward and reverse directions. Specifically, this hydraulic motor 4, including a first port 4*a* and a second port 4*b*, rotates the winch drum 5 in a lowering direction, i.e., in a direction to lower the suspended load 7, and discharges the hydraulic fluid through the second port 4*b*, when the hydraulic fluid is supplied to the first port 4*a*, while the hydraulic motor 4 rotates the winch drum 5 in a hoisting direction, i.e., in a direction to hoist the suspended load 7, and discharges the hydraulic fluid from the first port 4*a* when the hydraulic fluid is supplied to the second port 4*b*.

The hydraulic circuit, which is provided to supply and discharge the hydraulic fluid discharged from the hydraulic pump 2 to and from the hydraulic motor 4, includes as lines (pipes) for forming this circuit: a pump line 8P interconnecting a discharge port of the hydraulic pump 2 and the control valve 3; a first motor line 81M interconnecting the control valve 3 and the first port 4*a* of the hydraulic motor 4, a second motor line 82M interconnecting the control valve 3 and the second port 4*b* of the hydraulic motor 4, a bypass line 88 provided in parallel with this second motor line 82M; a first tank line 81T and a second tank line 82T provided independently of each other and interconnecting the control valve 3 and the tank; a regeneration line 83 interconnecting the second motor line 82M and the first motor line 81M; and a bleed-off line 86 branched off from the pump line 8P and reaching the tank.

The control valve 3 is interposed between the hydraulic pump 2 and the hydraulic motor 4 and switches a driving state of the winch drum 5 between a hoisting drive state and a lowering drive state according to an operation applied to the operating device 6. The control valve 3 according to this embodiment is configured by a three-position pilot-controlled selector valve including a lowering drive pilot port 3*a* and a hoisting drive pilot port 3*b*, and operated: to be held at a neutral position P0 when no pilot pressure is supplied to either of the pilot ports 3*a*, 3*b*; to be shifted from the neutral position P0 toward a lowering drive position P1 to be opened at a stroke corresponding to the pilot pressure when a pilot pressure is supplied to the lowering drive pilot port 3*a*; and to be shifted from the neutral position to a hoisting drive position P2 to be opened at a stroke corresponding to the pilot pressure when the pilot pressure is supplied to the hoisting drive pilot port 3*b*.

The control valve 3 forms the following flow passages at the above respective positions.

i) At the neutral position P0, the control valve 3 prevents the hydraulic fluid discharged from the hydraulic pump from being supplied to the hydraulic motor 4 and forms a first bleed-off flow passage for leading the hydraulic fluid directly to the tank through the first tank line 81T. Besides, the control valve 3 includes a bleed-off orifice 30 for specifying a bleed-off flow rate at this neutral position P0, the bleed-off orifice 30 having an opening area Abo which is reduced with a distance from the neutral position P0.

ii) At the lowering drive position P1, the control valve 3 connects the pump line 8P to the first motor line 81M to thereby open a flow passage for leading the hydraulic fluid discharged from the hydraulic pump 2 to the first port 4*a* of the hydraulic motor 4, namely, a "meter-in flow passage" for the lowering drive, and connects the second motor line 82M to the second tank line 82T to thereby open a flow passage for returning the hydraulic fluid discharged from the second port 4*b* of the hydraulic motor 4 to the tank, namely, a "meter-out flow passage" for the lowering drive. The control valve 3 further includes a meter-in orifice 31 for specifying a meter-in flow rate, which is a flow rate of the hydraulic fluid in the meter-in flow passage, at this lowering drive position P1, the meter-in orifice 31 having an opening area Ami which is increased with an increase in the stroke from the neutral position P0.

iii) At the hoisting drive position P2, the control valve 3 connects the pump line 8P to the second motor line 82M and the bypass line 88 provided in parallel with the second motor line 82M to thereby form a flow passage for leading the hydraulic fluid discharged from the hydraulic pump 2 to the second port 4*b* of the hydraulic motor 4 (exclusively through the bypass line 88 as described later) and connects the first motor line 81M to the second tank line 82T to thereby form a flow passage for returning the hydraulic fluid discharged from the first port 4*a* of the hydraulic motor 4 to the tank.

The operating device 6 includes a pilot fluid pressure source 9, a remote-control valve 10, a lowering-drive pilot line 11*a* and a hoisting-drive pilot line 11*b*.

The remote-control valve 10, interposed between the pilot fluid pressure source 9 and the respective pilot ports 3*a*, 3*b* of the control valve 3, includes an operation lever 10*a* to which an operation is applied by an operator and a valve main body 10*b* coupled to the operation lever 10*a*. The valve main body 10*b* includes a lowering-drive output port and a hoisting-drive output port, these output ports being connected to the pilot ports 3*a* and 3*b* of the control valve 3 through the lowering drive pilot line 11*a* and the hoisting drive pilot line 11*b*, respectively. The valve main body 10*b* is operated in tandem with the operation lever 10*a* so as to output a pilot pressure of a magnitude corresponding to the operation amount of the operation lever 10*a* from the output port corresponding to a direction of the operation applied to the operation lever 10*a* out of the both output ports and input to the pilot port corresponding to the output port out of the both pilot ports 3*a*, 3*b* of the control valve 3.

Figure 4:
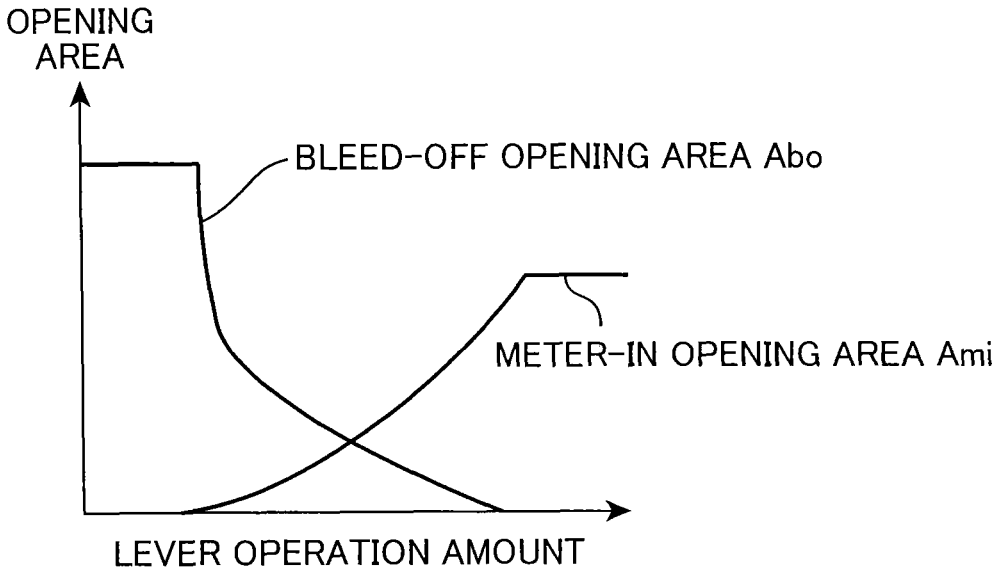
FIG. 4 is a graph showing a relationship between the lever operation amount and respective opening areas of a bleed-off orifice and the meter-in orifice.

As described above, since the stroke of the control valve 3 from its neutral position P0 to the lowering drive position P1 or the hoisting drive position P2 is increased corresponding to the magnitude of the input pilot pressure, the operator can change the operating direction and the stroke of the control valve 3 by the operation applied to the operation lever 10*a*, thereby varying respective opening areas Abo, Ami of the bleed-off orifice 30 and the meter-in orifice 31. A broken line of FIG. 2 indicates a relationship of the operation amount of the operation lever 10*a* (in the lowering direction) and the opening area Ami of the meter-in orifice 31, and FIG. 4 shows a relationship between the operation amount and the opening areas Abo, Ami of the bleed-off orifice 30 and the meter-in orifice 31.

The meter-in-flow-rate controller, in this embodiment, includes the meter-in orifice 31 and a meter-in-flow-rate regulating valve 23 provided in the bleed-off line 86. The meter-in-flow-rate regulating valve 23 is capable of being opened and closed to vary a flow rate of a second bleed-off flow passage formed by the bleed-off line 86, having an opening degree which is varied so as to make a difference between respective pressures upstream of and downstream of the meter-in orifice 31, i.e., a differential pressure across the meter-in orifice 31, be a predetermined set differential pressure. Specifically, upon the increase in the differential pressure across the meter-in orifice 31, the meter-in-flow-rate regulating valve 23 is operated in a valve opening direction to increase the flow rate in the bleed-off line 86, thereby suppressing the meter-in flow rate. In this embodiment, there are produced an outlet-side pressure of the control valve 3 at the lowering drive position P1, i.e., a pressure downstream of the meter-in orifice 31, and an inlet-side pressure of the meter-in-flow-rate regulating valve 23, i.e., a pump pressure as a pressure upstream of the meter-in orifice 31, into the meter-in-flow-rate regulating valve 23 from opposite sides through respective pressure introducing lines 22*a* and 22*b*, and the balance of the both pressures determines the opening area of the meter-in-flow-rate regulating valve 23 and a bleed-off flow rate corresponding thereto.

The meter-out-flow-rate controller is to control a meter-out flow rate, which is a flow rate of the hydraulic fluid in the meter-out flow passage, in accordance with an operation amount of the operating device 6 in a lowering driving direction, specifically the amount of the operation in the lowering driving direction applied to the operation lever 10*a* of the remote-control valve 10, namely, a lever operation amount; in this embodiment, the meter-out-flow-rate controller includes a meter-out orifice valve 36 and a meter-out-flow-rate regulating valve 14 provided in the second motor line 82M.

The meter-out orifice valve 36, which is equivalent to a meter-out orifice according to the present invention, includes an orifice 36*a* having a variable opening area and a pilot port 36*b*. The lowering-drive pilot pressure is input to the pilot port 36*b* through a branch line 11*c* which is branched off from the lowering drive pilot line 11*a*. Thus, the branch line 11*c* and a part of the lowering drive pilot line 11*a* upstream of a branching point of the branch line 11*a* constitute a meter-out pilot line for introducing the lowering-drive pilot pressure to the pilot port 36*b*. The meter-out orifice valve 36 has such an opening characteristic that the opening area of the orifice 36*a* is increased with an increase in the lowering-drive pilot pressure introduced to the pilot port 36*b*, i.e., with an increase in the operation amount of the operation lever 10*a* of the remote-control valve 10 in the lowering driving direction, while the opening area is kept minimum (preferably 0) when the operation amount is 0.

The meter-out-flow-rate regulating valve 14 is disposed, together with the meter-out orifice valve 36, at a position upstream of a connection position Pc of the second motor line 82M, the connection position Pc being a position at which the regeneration line 83 is connected to the second motor line 82M. The meter-out-flow-rate regulating valve 14 is operated to be opened or closed to make the differential pressure across the meter-out orifice valve 36, i.e., the difference between the pressures upstream of and downstream of the meter-out orifice valve 36 be a predetermined set differential pressure. Specifically, the meter-out-flow-rate regulating valve 14 includes a valve main body capable of being opened and closed and a spring 14*a* for biasing the valve main body in a valve opening direction; the pressure upstream of the meter-out orifice valve 36 is introduced to the meter-out-flow-rate regulating valve 14 through a pressure introducing line 18*a* from a side opposite to the spring 14*a*, while the pressure downstream of the meter-out orifice valve 36 is introduced to the meter-out-flow-rate regulating valve 14 through a pressure introducing line 18*b* from the same side as the spring 14*a*. Thus, the set differential pressure specified by the spring 14*a* and the difference between the upstream side pressure and the downstream side pressure determine an opening degree of the meter-out-flow-rate regulating valve 14*a* and a meter-out flow rate corresponding thereto. This meter-out-flow-rate regulating valve 14 may be provided downstream of the meter-out orifice valve 36 as shown in FIG. 1 or, conversely, may be provided upstream thereof.

Figure 2:
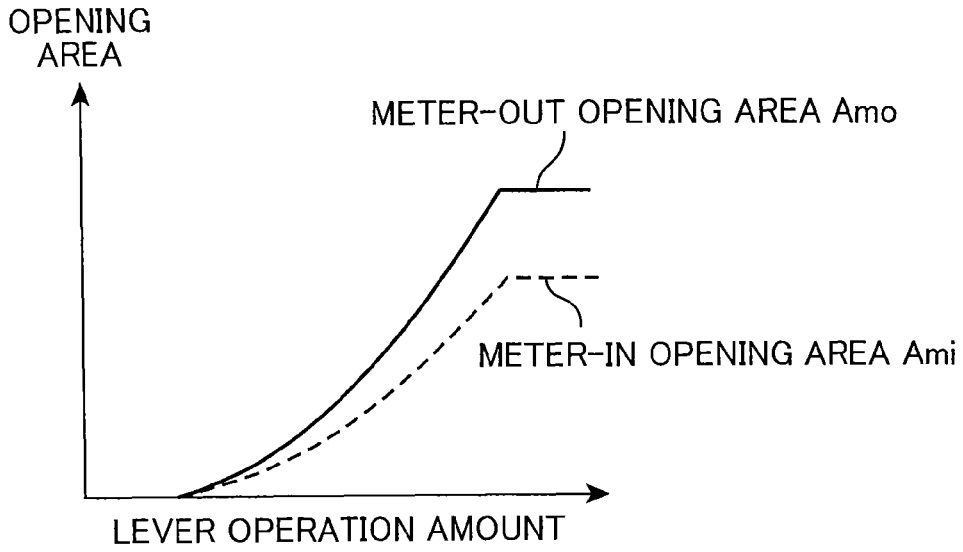
FIG. 2 is a graph showing a relationship between a lever operation amount of a remote-control valve of the apparatus shown in FIG. 1 and respective opening areas of a meter-out orifice in a meter-out-flow-rate controller and a meter-in orifice in a meter-in-flow-rate controller.
Figure 3:
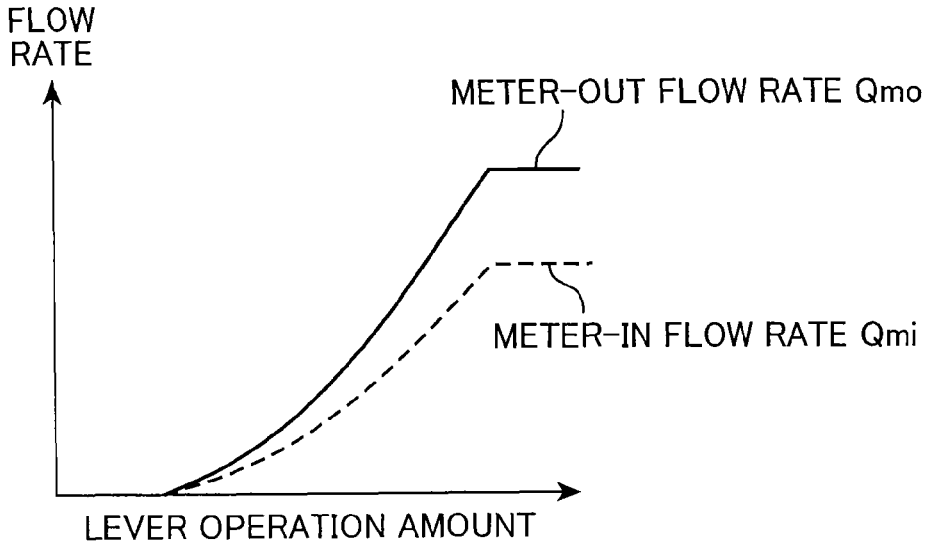
FIG. 3 is a graph showing a relationship between the lever operation amount and a meter-out flow rate and a meter-in flow rate.

The characteristic of the opening area of the meter-in orifice 31 constituting the meter-in-flow-rate controller, namely, the meter-in opening area Ami, and the characteristic of the opening area of the meter-out orifice valve 36 constituting the meter-out-flow-rate controller, namely, the meter-out opening area Amo, are set, as shown in FIG. 2, such that the meter-out opening area Amo is not smaller than the meter-in opening area Ami regardless of the lever operation amount, more specifically, such that the meter-out opening area Amo is larger than the meter-in opening area Ami except in a region where the lever operation amount is 0 or near 0. The apparatus according to this embodiment is thus given such a flow rate characteristic that the meter-out flow rate Qmo is kept not lower than the meter-in flow rate Qmi regardless of the lever operation amount, more specifically, the meter-out flow rate Qmo is kept higher than the meter-in flow rate Qmi except in the region where the lever operation amount is 0 or near 0 as shown in FIG. 3.

The back pressure valve 15, which is a pressure control valve constituting a back pressure generator, is disposed downstream of the connection position Pc of the regeneration line 83 in the second motor line 82M constituting the meter-out flow passage for lowering drive, and generates a back pressure equivalent to a set pressure of the back pressure valve 15. The set pressure of the back pressure valve 15 may be constantly fixed or may have, for example, such a characteristic as to decrease with an increase in a meter-in pressure, i.e., a pressure in the meter-in flow passage for the lowering drive. Alternatively, the back pressure valve 15 can also be a variable orifice valve having an opening area which is increased with an increase in the operation amount of the operation lever 10*a*. In this case, that opening area Abk is set to have, for example, such a characteristic as shown in the following Equation (1).

$$Abk=Qbk/\{Cv\times\sqrt{\Delta Pbk}\} \quad (1)$$

Here, Cv denotes a flow rate coefficient, ΔPbk denotes the set pressure of the back pressure valve and Qbk denotes a flow rate of the hydraulic fluid passing through the back pressure valve, the flow rate Qbk coinciding with the meter-in flow rate Qmi due to a flow rate balance if a leakage is ignored.

The regeneration line 83 forms a regeneration flow passage for supplying a part of the hydraulic fluid in the meter-out flow passage (hydraulic fluid having been flowed through the meter-out-flow-rate regulating valve 14) to the meter-in flow passage from a side upstream of the back pressure valve 15 at a flow rate corresponding to a difference between the meter-out flow rate Qmo and the meter-in flow rate Qmi (≤Qmo) during lowering drive. The check valve 13 is provided midway of the regeneration line 83 to limit a direction of the flow of the hydraulic fluid in the regeneration line 83 to a direction from the meter-out flow passage to the meter-in flow passage.

The second motor line 82M is further provided with a check valve 35 located downstream of the back pressure valve 15. The check valve 35 permits only a flow of the hydraulic fluid in a direction from the hydraulic motor 4 toward the control valve 3 and prevents an opposite flow, thereby preventing the hydraulic fluid discharged from the hydraulic pump 2 from backflow into the second motor line 82M when the control valve 3 is switched to the hoisting drive position P2.

The bypass line 88 forms a supply flow passage for bringing the hydraulic fluid into flow from the hydraulic pump 2 toward the second port 4*b* of the hydraulic motor 4 during hoisting drive. The bypass line 88 is provided with a check valve 27 for permitting only a flow of the hydraulic fluid in a direction from the control valve 3 toward the second port 4*b* of the hydraulic motor 4, contrary to the check valve 35.

The hydraulic drive apparatus shown in FIG. 1, as the feature thereof, further includes a meter-out-flow-rate limiter for forcibly limiting the meter-out flow rate in an emergency when the pressure of the hydraulic fluid in the meter-in flow passage falls to or below a permissible pressure set in advance. Specifically, the meter-out-flow-rate limiter is adapted to minimize (preferably set to 0) the opening area Amo of the meter-out orifice valve 36, namely, a flow passage area, in emergency. The meter-out-flow-rate limiter according to this embodiment includes: a pilot selector valve 40 equivalent to a pilot-line cutoff valve; and a pilot-pressure introduction line 41 equivalent to a cutoff operator.

The pilot selector valve 40 is provided midway of the meter-out pilot line, specifically, midway of the branch line 11*c* in this embodiment, and has an open position for opening the branch line 11*c* and a close position for blocking the branch line 11*c* and bringing the pilot port 36*b* of the meter-out orifice valve 36 into communication with the tank. This pilot selector valve 40 includes a spring 40*b* which holds the pilot selector valve 40 at the close position as graphically shown and a pilot port 40*a* to which the pilot pressure is introduced from a side opposite to the spring 40*b*. The pilot selector valve 40 is switched to the close position, only when a pilot pressure not lower than a specific pressure (permissible pressure) is introduced to the pilot port 40*a*, against a biasing force of the spring 40*b*.

The pilot-pressure introduction line 41 interconnects the first motor line 81M and the pilot port 40*a* to introduce the pressure in the first motor line 81M, i.e., the pressure in the meter-in flow passage during lowering drive, as the pilot pressure to the pilot port 40*a*.

Next will be described functions of this apparatus.

Upon an application of an operation for hoisting drive to the operation lever 10*a* of the remote-control valve 10, the remote-control valve 10 outputs a remote-control pressure, which is input to the hoisting drive pilot port 3*b* of the control valve 3 to cause the control valve 3 to be opened from the neutral position P0 toward the hoisting drive position P2. This allows the hydraulic fluid discharged from the hydraulic pump 2 to be supplied to the second port 4*b* of the hydraulic motor 4 via the check valve 27 in the bypass line 88 to rotate the hydraulic motor 4 in a hoisting drive direction. The hydraulic fluid discharged from the first port 4*a* of the hydraulic motor 4 is returned to the tank through the first motor line 81M and the second tank line 82T.

On the other hand, upon an application of an operation for lowering drive to the operation lever 10*a*, the control valve 3 is operated to be opened from the neutral position P0 toward the lowering drive position P1. Specifically, there is introduced a lowering-drive pilot pressure of a magnitude corresponding to the operation amount of the operation lever 10*a* from the remote-control valve 10 to the lowering drive pilot port 3*a* through the lowering drive pilot line 11*a*, thereby operating the control valve 3 toward the lowering drive position P1 by a stroke corresponding to the pilot pressure.

This operation decreases the bleed-off opening area Abo and increases the meter-in opening area Ami, which is the opening area of the meter-in orifice 31, as shown in FIG. 4, thereby increasing the meter-in flow rate Qmi, that is, a flow rate of the hydraulic fluid supplied from the hydraulic pump 2 to the first port 4*a* of the hydraulic motor 4. The hydraulic motor 4 is thereby rotated in a lowering direction while discharging the hydraulic fluid from the second port 4*b*. Thus discharged hydraulic fluid is returned to the tank through the second motor line 82M and the second tank line 82T constituting the meter-out flow passage.

At this time, with the increase in the opening area of the meter-in orifice 31, namely, the meter-in opening area Ami, the meter-in-flow-rate controller constituted by the meter-in orifice 31 and the meter-in-flow-rate regulating valve 23 controls the meter-in flow rate Qmi as shown in FIG. 3. Specifically, the meter-in-flow-rate regulating valve 23 is operated to be opened so as to make the differential pressure across the meter-in orifice 31 be a preset pressure, namely, a set differential pressure ΔPmi. For example, with the increase in the differential pressure across the meter-in orifice 31, the meter-in-flow-rate regulating valve 23 is operated in a valve opening direction to increase the bleed-off flow rate and thereby decrease the meter-in orifice flow rate. The meter-in flow rate Qmi is thus controlled, as shown by the following Equation (2).

$$Qmi=Cv\Delta Ami\times\sqrt{(\Delta Pmi)} \quad (2)$$

Meanwhile, the opening area of the orifice 36*a* of the meter-out orifice valve 36 provided in the second motor line 82M, namely, the meter-out opening area Amo, is varied in a range larger than that of the variation in the meter-in opening area Ami as shown in FIG. 2 according to the operation amount of the operation lever 10*a*. Associated with this, the meter-out-flow-rate controller constituted by the meter-out orifice valve 36 and the meter-out-flow-rate regulating valve 14 controls the meter-out flow rate Qmo to a flow rate not lower than the meter-in flow rate Qmi as shown in FIG. 3. Specifically, the meter-out-flow-rate regulating valve 14 is operated to be opened so as to make the differential pressure across the meter-out orifice valve 36 be a preset pressure, namely, a set differential pressure ΔPmo, thereby allowing the meter-out flow rate Qmo to be controlled as shown by the following Equation (3).

$$Qmo=Cv\times Amox\times\sqrt{(\Delta Pmo)} \quad (3)$$

While the meter-out flow rate Qmo is thus controlled, lowering drive is performed at a speed corresponding to the operation applied to the operation lever 10*a*, regardless of the weight of a load (suspended load 7 in this embodiment). In other words, the meter-out-flow-rate controller performs the control of the meter-out flow rate exclusively in accordance with the operation amount of the operation lever 10*a* regardless of a change in the weight of the suspended load 7 as the load. This makes it possible to effectively suppress a variation in the rotation speed of the hydraulic motor 4 due to an increase or decrease in the weight of the load to contribute to improved operability and safety.

In addition, this apparatus, controlling the meter-out flow rate Qmo to keep it constantly not lower than the meter-in flow rate Qmi, enables return fluid to be supplied to the first motor line 81M, which is the meter-in flow passage, from the connection position Pc upstream of the back pressure valve 15 through the regeneration line 83 at a flow rate (Qmo-Qmi) equivalent to a shortage of the meter-in flow rate Qmi. Thus, the flow of the hydraulic fluid from the meter-out flow passage to the meter-in flow passage through the regeneration flow passage is reliably produced, and further the flow is stably maintained by the control of both of the flow rates Qmi and Qmo. This allows the meter-in pressure to be maintained not lower than the set pressure of the back pressure valve 15, thus preventing cavitation due to a drop in the meter-in pressure.

As a conventional technique for preventing such cavitation, known is a technique with use of a counter balance valve; however, the use of such a counter balance valve has a disadvantage of involving hunting in the meter-in pressure or generation of a notable boost pressure. Contrary to this, the above apparatus is capable of preventing the cavitation with no use of the counter balance valve involving the disadvantage.

Figure 5:
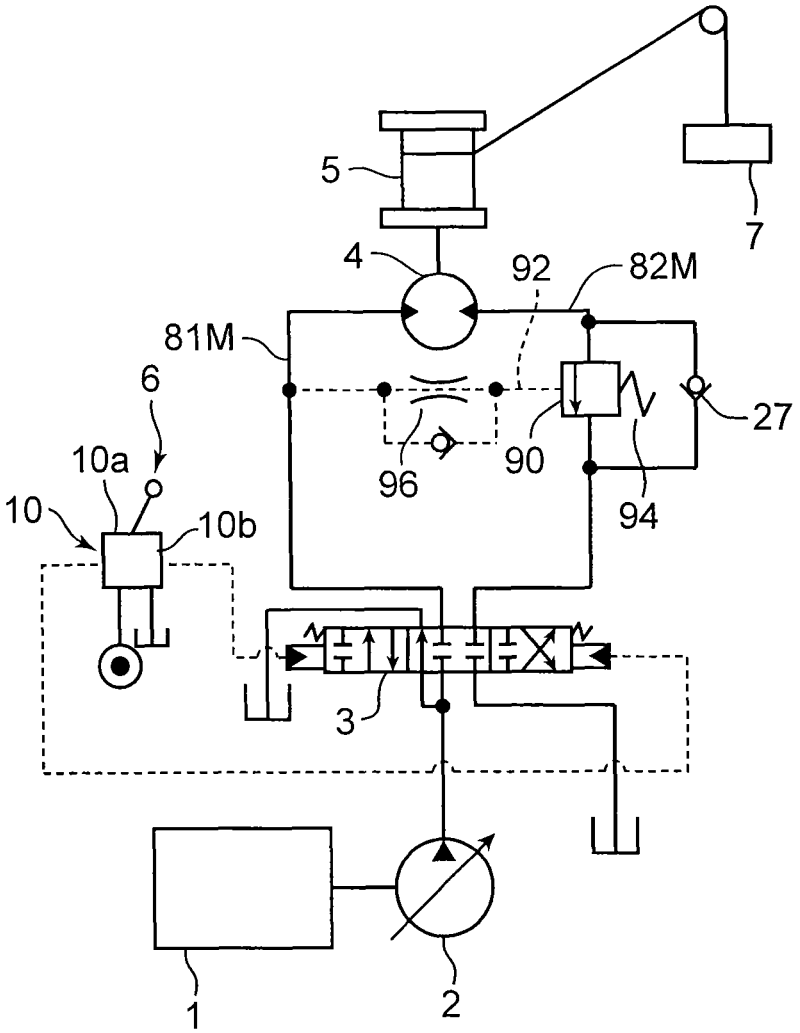
FIG. 5 is a circuit diagram showing a hydraulic drive apparatus according to a first comparative example.

The superiority of the inventive apparatus on this point is described in detail based on a comparison with an apparatus shown in FIG. 5 assumed as a first comparative example. This apparatus shown in FIG. 5, while including an engine 1, a hydraulic pump 2, a control valve 3, a hydraulic motor 4, an operating device 6 and both motor lines 81M, 82M similarly to the apparatus shown in FIG. 1, further includes an external-pilot-controlled counter balance valve 90 instead of the regeneration flow passage, the meter-in-flow-rate controller, the meter-out-flow-rate controller, and the back pressure valve 15 included in the apparatus shown in FIG. 1.

This counter balance valve 90 receives an introduction of a pressure in the first motor line 81M constituting a meter-in flow passage for lowering drive, namely, a meter-in pressure, as a pilot pressure through a line 92. The counter balance valve 90 includes a spring 94 determining a set pressure Pcb thereof, and is adapted to be closed when the pilot pressure input to the counter balance valve 90, namely, the meter-in pressure, is below the set pressure Pcb, and to be opened when the meter-in pressure is not lower than the set pressure Pcb.

Concerning the prevention of the cavitation due to a shortage of a meter-in flow rate, the counter balance valve 90 is also effective. For example, when the rotation speed of the hydraulic motor 4 is increased due to the weight of a suspended load 7 to thereby cause an absorbing flow rate thereof to exceed a supply flow rate from the hydraulic pump 2, the meter-in pressure decreases, but, upon decrease in the meter-in pressure to the set pressure Pcb of the counter balance valve 90, the counter balance valve 90 is operated in a valve closing direction to choke the meter-out side, thereby causing a braking force to be applied to the hydraulic motor 4. The absorbing flow rate of the hydraulic motor 4 is thus limited, allowing a control of keeping the meter-in pressure not lower than the set pressure Pcb to be achieved.

Figure 6A:
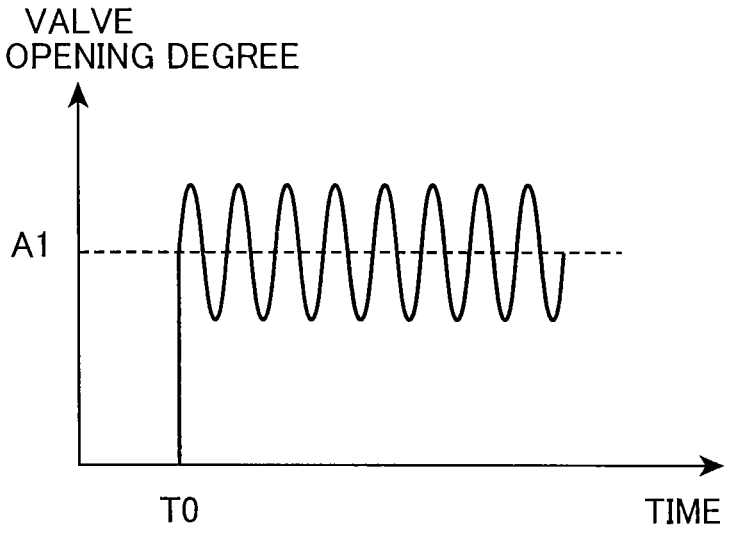
FIGS. 6A and 6B are graphs showing, respectively, hunting in counter balance valve opening degree and hunting in meter-in pressure which might occur in the apparatus shown in FIG. 5.
Figure 6B:
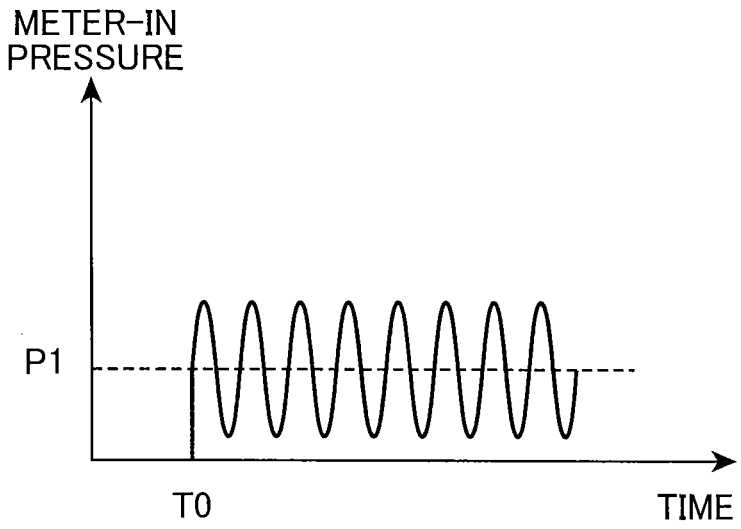

However, the control with use of the counter balance valve 90, where a measurement point is located in the meter-in flow passage while a control point is located in the meter-out flow passage, has no co-location in control theory, which makes the control be unstable. In other words, the position difference between the measurement point and the control point makes the control by the counter balance valve 90 be so unstable as to allow hunting to easily occur. Specifically, upon operation applied to the operation lever 10*a* of the remote-control valve 10 of the operating device 6 in a lowering driving direction to shift the lever 10*a* from a neutral position at time T0, there occurs hunting in the opening degree of the counter balance valve 90 as shown in FIG. 6A, and this hunting may cause also the meter-in pressure to vary in a vibrating manner as shown in FIG. 6B to thereby make the rotation speeds of the hydraulic motor 4 and a winch drum 5 be unstable.

Figure 7A:
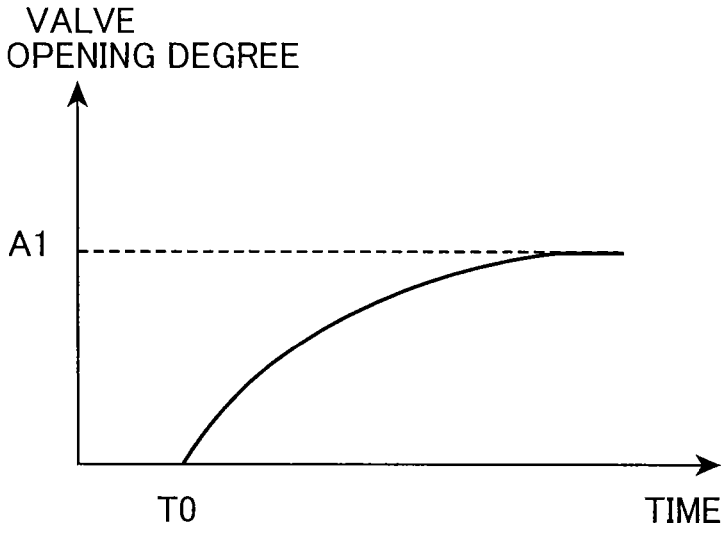
FIG. 7A is a graph showing a change with time in the valve opening degree immediately after the opening of the counter balance valve and FIG. 7B is a graph showing a change with time in the meter-in pressure associated with a change in the valve opening degree.
Figure 7B:
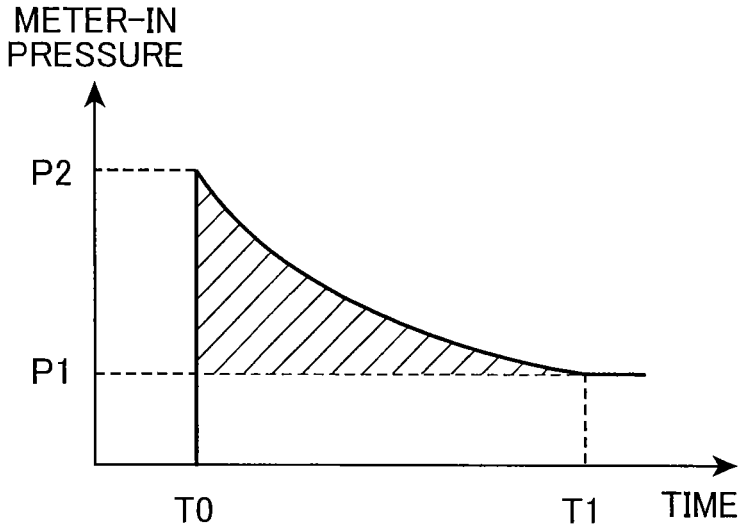

As a means for preventing this hunting, generally considered is providing an orifice 96 to the line 92 midway thereof as shown in FIG. 5; however, the orifice 96 causes a considerable response delay between time T0 when the operation of the operation lever 10*a* is started and a point of time when the valve opening reaches an appropriate opening degree A1 as shown in FIG. 7A. Furthermore, there occurs a great pressure loss in the counter balance valve 90 until the counter balance valve 90 is sufficiently opened, which causes a state where the meter-in pressure is higher than the set pressure Pcb, that is, a state where a useless boost pressure is generated as shown by hatching in FIG. 7B, to be continued from the operation start time T0 to specified time T1 as shown in FIG. 7B; this results in a disadvantage of drastically reducing operation efficiency.

Figure 8A:
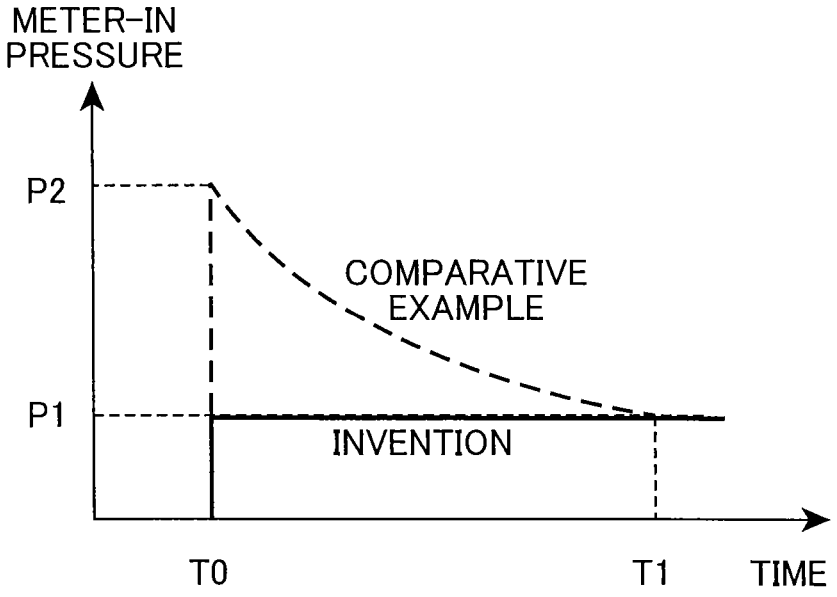
FIG. 8A is a graph showing respective changes with time in the meter-in pressure in the apparatus shown in FIG. 1 and the apparatus shown in FIG. 5
Figure 8B:
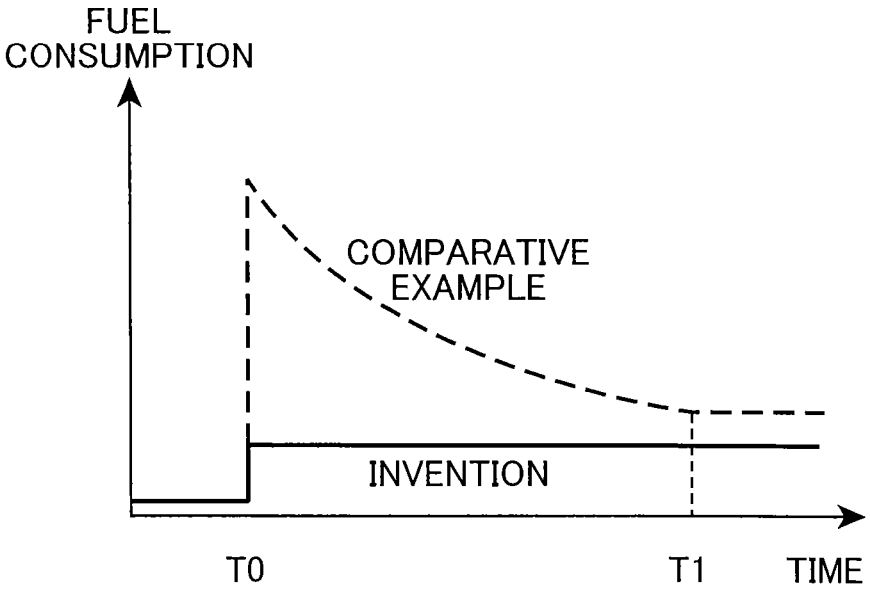
FIG. 8B is a graph showing respective changes with time in fuel consumption in the apparatus shown in FIG. 1 and the apparatus shown in FIG. 5.

On contrary, the meter-out-flow-rate controller used in the apparatus shown in FIG. 1, which regulates the meter-out flow rate based on the differential pressure across the meter-out orifice and has a measurement point and a control point both located in the meter-out flow passage, has a co-location in control theory, and is therefore capable of performing a stable control. Furthermore, the back pressure valve 15, which is very unlikely to involve hunting differently from the counter balance valve 90, requires no addition of a special orifice for preventing the hunting; therefore, there is no occurrence of the notable boost pressure as shown in FIG. 7B. Thus, as shown by solid line (apparatus shown in FIG. 1) and by broken line (apparatus shown in FIG. 5) in FIG. 8A, the meter-in pressure is effectively suppressed and power necessary to drive the hydraulic pump 2 is thereby reduced drastically, resulting in drastic improvement of also fuel consumption of the engine as shown in FIG. 8B.

Moreover, in the apparatus shown in FIG. 1, the meter-out flow rate is forcibly limited in an emergency when the pressure in the meter-in flow passage falls to or below the preset permissible pressure, which allows safety in the emergency to be guaranteed. Specifically, when the pressure of the hydraulic fluid in the meter-in flow passage, i.e., the pilot pressure input to the pilot selector valve 40 provided at the intermediate position of the branch line 11*c*, falls to or below the permissible pressure, the pilot selector valve 40 is switched from the previous open position to the close position to block the branch line 11*c* and bring the pilot port 36*b* of the meter-out orifice valve 36 into communication with the tank, thereby preventing the pilot pressure (lowering-drive pilot pressure) from being supplied to the meter-out orifice valve 36 through the branch line 11*c*. The meter-out orifice valve 36 is thereby operated so as to minimize the opening area of the orifice 36*a* thereof (0 in the characteristic shown in FIG. 2), making the meter-out flow rate Qmo be minimum value or 0, which allows the rotation of the hydraulic motor 4 to be effectively suppressed or stopped.

For example, in the case of a sudden pressure drop in the meter-out flow passage due to the occurrence of an abnormality such as breakage of the second motor line 82M (pipe) forming the meter-in flow passage, cavitation could occur in the meter-in flow passage if the situation is left as it is, disabling the drive control of the hydraulic motor impossible and thus allowing the load moving in the lowering direction to suddenly fall down. However, even in such a case, a sudden fall of the load can be prevented by forcible limitation of the meter-out flow rate to effectively suppress or forcibly stop the rotation of the hydraulic motor 4 in a lowering driving direction.

In addition, the limitation of the meter-out flow rate is performed by utilization of the meter-out orifice valve 36 constituting the meter-out-flow-rate controller, specifically, by minimizing the opening area of the meter-out orifice valve 36; this makes it possible, differently from a case of, for example, installing a large-size safety valve in the meter-out flow passage and closed in an emergency, to enhance safety during lowering drive without an increase in a pressure loss in a normal operating state or enlargement of the entire apparatus due to the additional installation of the safety valve.

Figure 9:
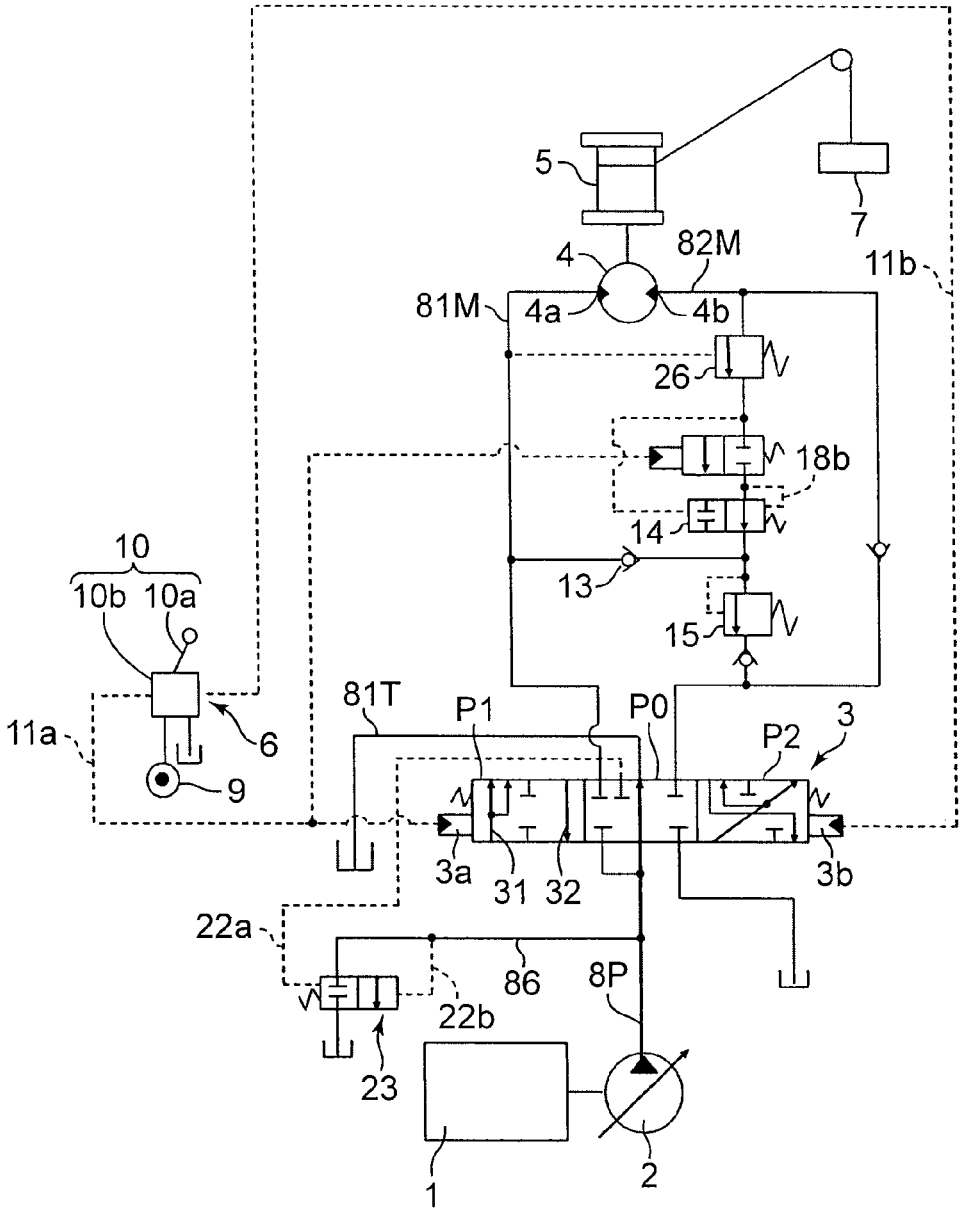
FIG. 9 is a circuit diagram showing a hydraulic drive apparatus according to a second comparative example.

This advantage is described in contrast to an apparatus shown in FIG. 9 assumed as a second comparative example. In the apparatus shown in FIG. 9, provided is a pilot-controlled safety valve 26 in a second motor line 82M constituting a meter-out flow passage during lowering drive instead of the above meter-out-flow-rate controller. The pilot-controlled safety valve 26, which receives an input of a pressure in a first motor line 81M as a pilot pressure, is configured to be closed only when the pilot pressure thereof, i.e., a meter-in pressure during lowering drive, is not higher than a preset permissible pressure, in other words, configured to be opened when the meter-in pressure becomes higher than the set pressure.

This apparatus shown in FIG. 9, always allowing return fluid from a hydraulic motor 4 to pass through the pilot-controlled safety valve 26 even when normal lowering drive is performed, has a drawback of the pressure loss in the pilot-controlled safety valve 26, the pressure loss degrading operation efficiency of the apparatus. Besides, the pilot-controlled safety valve 26, which is required to forcibly block a meter-out flow passage in which hydraulic fluid flows at a high flow rate (meter-out flow rate), has to be a considerably large valve compared with the pilot selector valve 40 shown in FIG. 1. The pilot-controlled safety valve 26 is, therefore, a serious hindrance to the miniaturization of the entire apparatus.

On contrary, the apparatus shown in FIG. 1, performing the urgent limitation of the meter-out flow rate by utilization of the meter-out orifice valve 36 which has been originally equipped for the meter-out flow rate control, requires no addition of a special valve in the second motor line 82M for the urgent limitation, thus involving no increase in the pressure loss. Besides, since the pilot selector valve 40 used for an urgent operation of the meter-out orifice valve 36 only has to block the pilot line (branch line 11*c* in FIG. 1) for the supply of the pilot pressure (not the meter-out flow passage for driving the hydraulic motor 4), only a small-sized selector valve is required to constitute the pilot selector valve 40, in comparison with the pilot-controlled safety valve 26.

Furthermore, in the apparatus shown in FIG. 1, the pilot selector valve 40 is used as a pilot-line cutoff valve and the pilot port 40*a* of the pilot selector valve 40 and the first motor line 81M constituting the meter-in flow passage are interconnected through the pilot-pressure introduction line 41 to utilize the pressure in the meter-in flow passage as the pilot pressure of the pilot selector valve 40; this allows a preferable meter-out-flow-rate limiting operation in direct relation to an actual pressure in the meter-in flow passage to be realized, while requiring no special control device.

Figure 10:
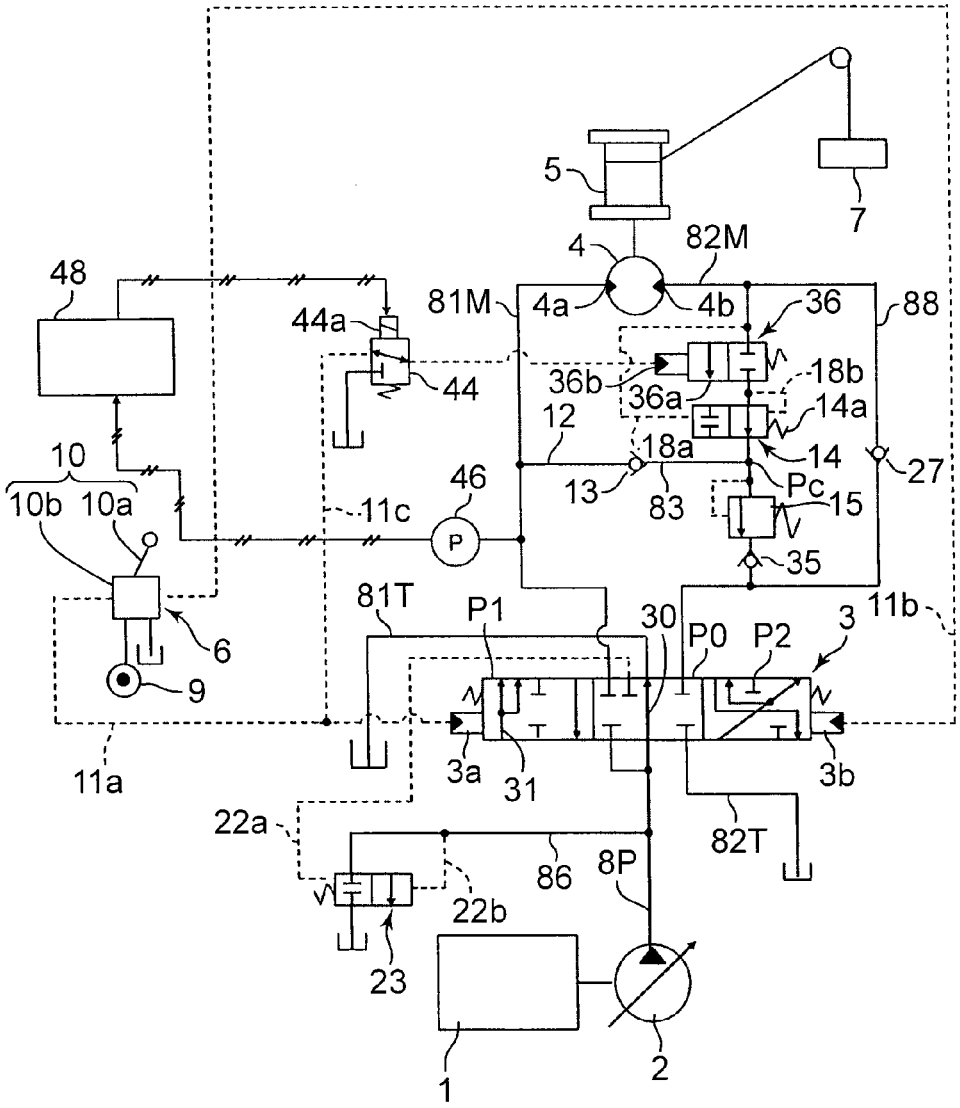
FIG. 10 is a circuit diagram showing a hydraulic drive apparatus for working machine according to a second embodiment of the present invention.

The present invention is, however, not limited to specific operation means for the pilot-line cutoff valve but permits, for example, the operation to be electrically performed. FIG. 10 shows an example thereof as a second embodiment. The apparatus shown in FIG. 10 includes, instead of the hydraulically controlled pilot selector valve 40, an electromagnetic valve 44 constituting the pilot-line cutoff valve similarly to the pilot selector valve 40, and a pressure sensor 46 and a controller 48 which constitute the cutoff operator. The electromagnetic valve 44, which is provided midway of a branch line 11*c* similarly to the pilot selector valve 40, includes a solenoid 44*a* and is adapted to open the branch line 11*c* when no electrical signal is input to the solenoid 44*a* and to block the branch line 11*c* only when an electrical signal is input. The pressure sensor 46 detects a pressure in a meter-in flow passage, i.e., a pressure in a first motor line 81M in FIG. 10, and inputs a detection signal thereon to the controller 48. The controller 48 constitutes a cut-off controller which inputs the electrical signal to the solenoid 44*a* of the electromagnetic valve 44 only when the pressure detected by the pressure sensor 46 is not higher than a preset permissible pressure.

Also in this apparatus, in an emergency when the pressure in the meter-in flow passage falls to or below the preset permissible pressure, it is possible to minimize an opening area of the meter-out orifice valve 36 to suppress or stop the rotation of the hydraulic motor 4, because the controller 48 inputs an electrical signal to the electromagnetic valve 44 to forcibly block the branch line 11*c*.

Figure 11:
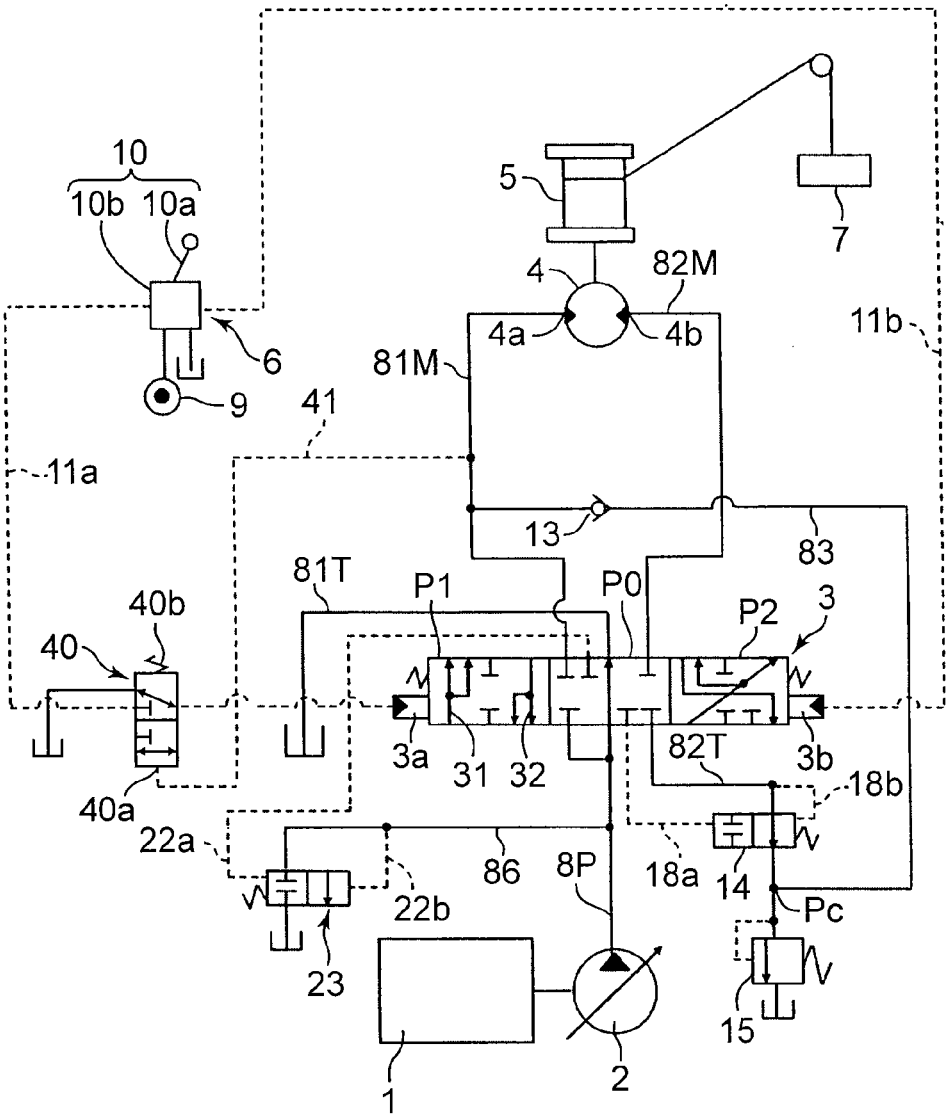
FIG. 11 is a circuit diagram showing a hydraulic drive apparatus for working machine according to a third embodiment of the present invention.

FIG. 11 shows an apparatus according to a third embodiment of the present invention. The apparatus differs from the apparatus shown in FIG. 1 in the following points.

1) Positions of Respective Valves

While the apparatus shown in FIG. 1 involves an arrangement where all of the meter-out-flow-rate regulating valve 14, the connection position Pc of the regeneration line 83 and the back pressure valve 15 are provided upstream of the control valve 3 in the second motor line 82M, the apparatus shown in FIG. 11 involves an arrangement where a meter-out-flow-rate regulating valve 14, a connection position Pc of a regeneration line 83 and a back pressure valve 15 are all provided downstream of a control valve 3 in a second tank line 82T. Specifically, the regeneration line 83 is disposed so as to interconnect a first motor line 81M and the second tank line 82T, and the meter-out-flow-rate regulating valve 14 and the back pressure valve 15 are disposed at respective upstream and downstream sides of the connection position Pc of the regeneration line 83 and the second motor line 82M. This arrangement allows the apparatus shown in FIG. 11 to be free from the need for the check valve 35 and the bypass line 88 shown in FIG. 1.

2) Meter-Out Orifice

While the apparatus shown in FIG. 1 involves an arrangement where the meter-out orifice valve 36 constituting the meter-out orifice is provided in the second motor line 82M independently of the control valve 3, the apparatus shown in FIG. 11 involves an arrangement where a meter-out orifice 32 is provided in the control valve 3 similarly to the meter-in orifice 31. Specifically, the control valve 3, similarly to the control valve 3 shown in FIG. 1, forms a return flow passage interconnecting the second motor line 82M and the second tank line 82T at a lowering drive position P1, while this return flow passage constitutes the meter-out orifice 32. This meter-out orifice 32 has a characteristic that an opening area thereof is increased with an increase in a stroke of the control valve 3 similarly to the meter-in orifice 31. Thus providing the meter-out orifice 32 in the control valve 3 allows the lowering drive pilot line 11*a*, i.e., a pilot line interconnecting the remote-control valve 10 and the lowering drive pilot port 3*a* of the control valve 3 to be also used as a "meter-out pilot line" according to the present invention.

For the extraction of the differential pressure across the meter-out orifice 32, a pressure upstream of the meter-out orifice 32 is introduced from the control valve 3 to the first port of the meter-out-flow-rate regulating valve 14 through a line 18*a* and a pressure downstream of the meter-out orifice 32 (inlet-side pressure of the meter-out-flow-rate regulating valve 14 in FIG. 11) is introduced to the second port (port opposite to the first port) of the meter-out-flow-rate regulating valve 14 through a line 18*b*.

3) Pilot-Line Cutoff Valve

In the apparatus shown in FIG. 11, where the lowering drive pilot line 11*a* is also used as the meter-out pilot line according to the present invention, the pilot selector valve 40 equivalent to the pilot-line cutoff valve is provided midway of the lowering drive pilot line 11*a*. The pilot port 40*a* of the pilot selector valve 40 is connected to the first motor line 81M through a pilot-pressure introduction line 41, similarly to the apparatus shown in FIG. 1, to allow the pressure in the meter-in flow passage for the lowering drive, i.e., a pressure in the first motor line 81M, to be input as a pilot pressure of the pilot selector valve 40 to the pilot selector valve 40. The pilot selector valve 40 is switched from an open position graphically shown to a close position only when the input pilot pressure is not higher than a preset permissible pressure and, at this close position, blocks the pilot line 11*a* and brings the lowering drive pilot port 3*a* into communication with a tank.

Also in this apparatus, during lowering drive, the control valve 3 is shifted to a lowering drive position P1 by a stroke corresponding to an operation amount of the operation lever 10*a*, the opening area of the meter-out orifice 32 in the control valve 3 being varied according to the stroke, and the meter-out-flow-rate regulating valve 14 is thus operated to keep a differential pressure across the meter-out orifice 32 at a predetermined pressure, whereby the control of the meter-out flow rate is performed so as to meet an operation, regardless of the weight of a load (suspended load 7). Besides, in an emergency when the pressure in the meter-in flow passage is not higher than the permissible pressure, the pilot selector valve 40 as the pilot-line cutoff valve blocks the lowering drive pilot line 11*a* and brings the lowering drive pilot port 3*a* into communication with the tank, thereby forcibly returning the control valve 3 to its neutral position P0 regardless of the operation position of the operation lever 10*a*. The opening area of the meter-out orifice 32 is thus minimized (preferably 0), which effectively limits the meter-out flow rate to suppress or forcibly stop the rotation of the hydraulic motor 4.

It goes without saying that also the apparatus shown in FIG. 11 permits an electrically controlled meter-out-flow-rate controller including the electromagnetic valve 44, the pressure sensor 46 and the controller 48 shown in FIG. 10 to be used instead of the pilot selector valve 40.

The control valve 3 is not limited to a pilot-controlled hydraulic selector valve but may be, for example, a three-position electromagnetic selector valve. Also in this case, stable lowering drive is realized if the meter-out-flow-rate controller is adapted to control the meter-out flow rate according to an operation in the operating device, for example, if the meter-out-flow-rate controller is based on a combination of the meter-out orifice valve 36 and the meter-out-flow-rate regulating valve 14 as shown in FIG. 1.

The "back pressure generator" according to the present invention may not necessarily include the back pressure valve 15. For example, in the case where a required back pressure can be ensured even without a special back pressure valve because of a great pressure loss of another device (e.g. valve) or a pipe provided downstream of the connection position Pc, the "back pressure generator" can also be configured only by the device or the pipe which causes the pressure loss.

The hydraulic actuator according to the present invention is not limited to the hydraulic motor but may be, for example, a hydraulic cylinder for pivot turning an attachment of a work device. For example, also in the case of driving the hydraulic cylinder to move the attachment as a load in a lowering direction which is the same direction as a direction in the load falls by its own weight, the present invention can also be effectively applied. Alternatively, the hydraulic actuator may be a variable displacement motor.

As described above, according to the present invention, provided is a hydraulic drive apparatus for working machine capable of preventing a pressure on a meter-in side from excessive drop while involving no drawbacks of a conventional counter balance valve, namely, no occurrence of hunting and the generation of a large boost pressure, and capable of moving a load in a lowering direction, which is the same direction as a self-weight falling direction in which the load falls by its own weight, at a stable speed. The hydraulic drive apparatus includes: a hydraulic pump; a drive source for driving the hydraulic pump and making the hydraulic pump discharge hydraulic fluid; a hydraulic actuator which includes a first port and a second port and is operated to move the load in the lowering direction by receiving supply of the hydraulic fluid discharged from the hydraulic pump through the first port and discharges the hydraulic fluid through the second port; a hydraulic circuit which includes a meter-in flow passage for leading the hydraulic fluid from the hydraulic pump to the first port of the hydraulic actuator in moving the load in the lowering direction, a meter-out flow passage for leading the hydraulic fluid discharged from the second port of the hydraulic actuator to a tank in moving the load in the lowering direction and a regeneration flow passage for bringing the meter-out flow passage into communication with the meter-in flow passage; a control valve which is operated to change a state of the supply of the hydraulic fluid from the hydraulic pump to the hydraulic actuator; an operating device for operating the control valve; a meter-in-flow-rate controller for controlling a meter-in flow rate, which is a flow rate of the hydraulic fluid in the meter-in flow passage; a meter-out-flow-rate controller for controlling a meter-out flow rate, which is a flow rate of the hydraulic fluid in the meter-out flow passage upstream of a position where the regeneration flow passage is connected to the meter-out flow passage, so as to make the meter-out flow rate be not lower than the meter-in flow rate controlled by the meter-in-flow-rate controller; a back pressure generator provided at a position downstream of the position where the regeneration flow passage is connected to the meter-out flow passage in the meter-out flow passage to generate a set back pressure; a check valve provided in the regeneration flow passage to limit a direction of the flow of the hydraulic fluid in the regeneration flow passage to a direction from the meter-out flow passage to the meter-in flow passage; and a meter-out-flow-rate limiter for forcibly limiting the meter-out flow rate when a pressure of the hydraulic fluid in the meter-in flow passage falls to or below a preset permissible pressure. The meter-out-flow-rate controller includes a meter-out orifice provided in the meter-out flow passage and having a variable flow passage area and a meter-out-flow-rate regulating valve for varying the meter-out flow rate so as to make a differential pressure across the meter-out orifice be a set pressure. The meter-out-flow-rate limiter minimizes the flow passage area of the meter-out orifice, preferably, makes the meter-out orifice be fully closed, when the pressure of the hydraulic fluid in the meter-in flow passage falls to or below the permissible pressure. The back pressure generator may be a back pressure valve for generating a set back pressure or may be another device (valve or the like) or a pipe, other than the back pressure valve, provided at a downstream side of the meter-out flow passage, which device or pipe has a large pressure loss enough to ensure a required back pressure, that is, the back pressure generator may be configured based on utilization of the pressure loss.

In this hydraulic drive apparatus, the hydraulic fluid is flowed into the meter-in flow passage through the regeneration flow passage from a branching point upstream of the back pressure generator, during the lowering drive for moving the suspended load in the same direction as the self-weight falling direction, under the condition where the pressure in the meter-out flow passage upstream of the back pressure generator is kept not lower than the back pressure generated in the back pressure generator; this makes a minimum pressure in the meter-in flow passage be not lower than the back pressure. Thus, cavitation in the meter-in flow passage is effectively suppressed. In addition, the meter-in-flow-rate controller and the meter-out-flow-rate controller, controlling the meter-in flow rate and the meter-out flow rate to make the meter-out flow rate be not lower than the meter-in flow rate, ensures the flow of the hydraulic fluid from the meter-out flow passage to the meter-in flow passage through the regeneration flow passage, in short, enables a regeneration flow rate to be secured.

The meter-out-flow-rate controller, including the meter-out orifice and the meter-out-flow-rate regulating valve for varying the meter-out flow rate to make the differential pressure across the meter-out orifice be the preset pressure and thus having a measurement point and a control point thereof both located in the meter-out flow passage, has a co-location in control theory, differently from a conventional counter balance valve having a measurement point located in a meter-in flow passage while having a control point located in a meter-out flow passage. Hence, hunting in the valve opening degree and pressure of the meter-out-flow-rate regulating valve is effectively suppressed. In summary, the hydraulic drive apparatus is capable of suppressing cavitation in the meter-in flow passage with no use of a valve prone to hunting in valve opening degree and pressure and, as a result, suppressing hunting in the driving speed of the hydraulic actuator.

Furthermore, the hydraulic drive apparatus, including the meter-out-flow-rate limiter for forcibly limiting the meter-out flow rate when the pressure of the hydraulic fluid in the meter-in flow passage falls to or below the preset permissible pressure, is capable of guaranteeing safety when an abnormality occurs in the meter-in flow passage and the like. For example, in the case of a sudden pressure drop in the meter-out flow passage due to the occurrence of an abnormality such as breakage of a pipe forming the meter-in flow passage, cavitation may occur in the meter-in flow passage to make the drive control of the hydraulic motor impossible and allow the load moving in the lowering direction to suddenly fall down; however, in such a case, the meter-out-flow-rate limiter forcibly limits the meter-out flow rate to effectively suppress or forcibly stop the rotation of the hydraulic actuator in a lowering driving direction, thereby preventing the load from the sudden fall.

In addition, since the limitation of the meter-out flow rate is performed by utilization of the meter-out orifice constituting the meter-out-flow-rate controller, specifically, by minimizing the opening area of the meter-out orifice, safety during lowering drive can be enhanced while involving no increase in a pressure loss in a normal operating state and an enlargement of the entire apparatus due to the installation of a safety valve, differently from a case of, for example, installing a large-size safety valve in the meter-out flow passage which is closed in an emergency. Particularly in the case where the minimum opening area of the meter-out orifice is equal to 0, it is possible to also forcibly stop the hydraulic actuator by fully closing the meter-out orifice when the pressure in the meter-in flow passage falls to or below the permissible pressure.

In the present invention, it is preferable, for example, that: the control valve is configured by a pilot selector valve which is operated by supply of a pilot pressure; the operating device includes a remote-control valve for outputting the pilot pressure to be supplied to the control valve and a meter-out pilot line for introducing a lowering-drive pilot pressure for operating the control valve to drive the actuator in a lowering direction out of the pilot pressure output by the remote-control valve to the meter-out orifice, and the meter-out orifice is operated to be opened according to the lowering-drive pilot pressure introduced by the meter-out pilot line. In this case, it is possible to vary the opening area of the meter-out orifice based on an operation applied for the control valve, that is, to vary the meter-out flow rate to thus vary a driving speed in the lowering direction of the hydraulic actuator.

In this case, the meter-out-flow-rate limiter is preferably provided midway of the meter-out pilot line and preferably includes: a pilot-line cutoff valve having an open position for opening the meter-out pilot line and a close position for cutting off the meter-out pilot line to prevent the pilot pressure from being supplied to the meter-out orifice; and a cutoff operator for switching the pilot-line cutoff valve to the close position only when the pressure in the meter-in flow passage falls to or below the permissible pressure. This makes it possible to perform an urgent operation of the meter-out orifice by a simple configuration utilizing the lowering drive pilot line.

The invention is not limited to a specific means of operating the pilot-line cutoff valve by the cutoff operator. The pilot-line cutoff valve may be, for example, hydraulically operated or electrically operated. As a preferable example of the former, the pilot-line cutoff valve is a pilot selector valve which has the open position and the close position and is switched to the open position only in the case of receiving the supply of a pilot pressure not lower than a specific pressure, and the cutoff operator includes a pilot-pressure introduction line for introducing the pressure in the meter-in flow passage as a pilot pressure of the pilot-line cutoff valve to the pilot-line cutoff valve. The pilot-pressure introduction line allows the pressure in the meter-in flow passage to be utilized as the pilot pressure of the pilot-line cutoff valve, thus enabling the pilot-line cutoff valve to be properly operated by a simple configuration. In an example of the latter, preferably, the pilot-line cutoff valve is an electromagnetic valve which is switched between the open position and the close position by the input of an electrical signal, and the cutoff operator includes a pressure sensor for detecting the pressure in the meter-in flow passage and a cutoff controller for inputting the electrical signal to the pilot-line cutoff valve to switch the pilot-line cutoff valve to the close position only when the pressure detected by the pressure sensor is not higher than the permissible pressure.

The meter-out orifice may be configured independently of the control valve or may be provided in the control valve so as to vary the opening area of the meter-out orifice with the operation of the control valve. In the latter case, if the remote-control valve is provided and a pilot pressure output by this remote-control valve is used for the urgent operation of the meter-out orifice, this results in that the meter-out pilot line is configured by a lowering drive pilot line connecting the control valve to the remote-control valve to allow the lowering-drive pilot pressure to be supplied to the control valve. In this case, the pilot-line cutoff valve is preferably provided midway of the lowering drive pilot line used as the meter-out pilot line.

This application is based on Japanese Patent application No. 2012-249062 filed in Japan Patent Office on Nov. 13, 2012, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A hydraulic drive apparatus for working machine for hydraulically moving a load in a lowering direction, which is the same direction as a self-weight falling direction by the own weight of the load, comprising:

a hydraulic pump;

a drive source for driving the hydraulic pump and making the hydraulic pump discharge hydraulic fluid;

a hydraulic actuator which includes a first port and a second port and is operated to move the load in the lowering direction by receiving supply of the hydraulic fluid discharged from the hydraulic pump through the first port and discharges the hydraulic fluid through the second port;

a hydraulic circuit which includes a meter-in flow passage for leading the hydraulic fluid from the hydraulic pump to the first port of the hydraulic actuator in moving the load in the lowering direction, a meter-out flow passage for leading the hydraulic fluid discharged from the second port of the hydraulic actuator to a tank in moving the load in the lowering direction and a regeneration flow passage for bringing the meter-out flow passage into communication with the meter-in flow passage;

a control valve which is operated to change a state of the supply of the hydraulic fluid from the hydraulic pump to the hydraulic actuator;

an operating device for operating the control valve;

a meter-in-flow-rate controller for controlling a meter-in flow rate, which is a flow rate of the hydraulic fluid in the meter-in flow passage;

a meter-out-flow-rate controller for controlling a meter-out flow rate, which is a flow rate of the hydraulic fluid in the meter-out flow passage upstream of a position where the regeneration flow passage is connected to the meter-out flow passage, so as to make the meter-out flow rate be not lower than the meter-in flow rate controlled by the meter-in-flow-rate controller;

a back pressure generator provided at a position downstream of the position where the regeneration flow passage is connected to the meter-out flow passage in the meter-out flow passage to generate a set back pressure;

a check valve provided in the regeneration flow passage to limit a direction of the flow of the hydraulic fluid in the regeneration flow passage to a direction from the meter-out flow passage to the meter-in flow passage; and a meter-out-flow-rate limiter for forcibly limiting the meter-out flow rate when a pressure of the hydraulic fluid in the meter-in flow passage falls to or below a preset permissible pressure;

wherein:

the meter-out-flow-rate controller includes a meter-out orifice valve provided in the meter-out flow passage and having a pilot port and variable flow passage area and a meter-out-flow-rate regulating valve for varying the meter-out flow rate so as to make a differential pressure across the meter-out orifice be a set pressure;

the meter-out-flow-rate limiter minimizes the flow passage area of the meter-out orifice when the pressure of the hydraulic fluid in the meter-in flow passage falls to or below the permissible pressure, the control valve is configured by a pilot selector valve which is operated by the supply of a pilot pressure;

the operating device includes a remote-control valve for outputting the pilot pressure to be supplied to the control valve and a meter-out pilot line for introducing a lowering-drive pilot pressure for operating the control valve to drive the actuator in a lowering direction out of the pilot pressure output by the remote-control valve to the pilot port of the meter-out orifice valve;

the meter-out orifice valve has an opening characteristic in which the opening area of the orifice is increased with an increase in the lowering-drive pilot pressure introduced to the pilot port of the meter-out orifice valve through the meter-out pilot line, and the meter-out-flow-rate limiter is provided midway of the meter-out pilot line and includes: a pilot-line cutoff valve having an open position for opening the meter-out pilot line to allow the lowering-drive pilot pressure to be introduced to the pilot port of the meter-out orifice valve through the meter-out pilot line and a close position for blocking the meter-out pilot line to prevent the lowering-drive pilot pressure from being introduced to the pilot port of the meter-out orifice; and a cutoff operator for switching the pilot-line cutoff valve to the close position to forcibly minimize the flow passage area of the meter-out orifice valve only when the pressure in the meter-in flow passage falls to or below the permissible pressure.

2. A hydraulic drive apparatus for working machine according to claim 1, wherein the pilot-line cutoff valve is a pilot selector valve having the open position and the close position and is switched to the open position only when receiving the supply of a pilot pressure not lower than a specific pressure, and the cutoff operator includes a pilot-pressure introduction line for introducing the pressure in the meter-in flow passage as a pilot pressure of the pilot-line cutoff valve to the pilot-line cutoff valve.

3. A hydraulic drive apparatus for working machine according to claim 1, wherein the pilot-line cutoff valve is an electromagnetic valve which is switched between the open position and the close position by the input of an electrical signal and the cutoff operator includes a pressure sensor for detecting the pressure in the meter-in flow passage and a cutoff controller for inputting the electrical signal to the pilot-line cutoff valve to switch the pilot-line cutoff valve to the close position only when the pressure detected by the pressure sensor is not higher than the permissible pressure.

4. A hydraulic drive apparatus for working machine according to claim 1, wherein: the meter-out orifice is provided in the control valve so as to vary the opening area of the meter-out orifice with the operation of the control valve; the meter-out pilot line includes a lowering drive pilot line connecting the control valve to the remote-control valve so as to allow the lowering-drive pilot pressure to be supplied to the control valve; and the pilot-line cutoff valve is provided midway of the lowering drive pilot line.

* * * * *